US010556433B2

(12) United States Patent
Ishiwata et al.

(10) Patent No.: US 10,556,433 B2
(45) Date of Patent: Feb. 11, 2020

(54) LIQUID DISCHARGE APPARATUS AND CLEANING METHOD FOR LIQUID DISCHARGE HEAD

(71) Applicant: CANON KABUSHIKI KAISHA, Tokyo (JP)

(72) Inventors: Tomoki Ishiwata, Kawasaki (JP); Takatsugu Moriya, Tokyo (JP); Shinya Asano, Tokyo (JP); Kanto Kurasawa, Tokyo (JP); Ryosuke Araki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/244,943

(22) Filed: Jan. 10, 2019

(65) Prior Publication Data

US 2019/0232665 A1 Aug. 1, 2019

(30) Foreign Application Priority Data

Jan. 29, 2018 (JP) ..... 2018-012546

(51) Int. Cl.
*B41J 2/14* (2006.01)
*B41J 2/165* (2006.01)
*B41J 2/135* (2006.01)

(52) U.S. Cl.
CPC ..... *B41J 2/16544* (2013.01); *B41J 2/135* (2013.01); *B41J 2/14* (2013.01); *B41J 2/1404* (2013.01); *B41J 2/1433* (2013.01); *B41J 2/16535* (2013.01); *B41J 2002/1655* (2013.01)

(58) Field of Classification Search
CPC ... B41J 2/135; B41J 2/14; B41J 2/1404; B41J 2/1433; B41J 2002/14387; B41J 2002/14475; B41J 2/16535; B41J 2/16544; B41J 2002/1655
See application file for complete search history.

(56) References Cited

U.S. PATENT DOCUMENTS

2015/0124023 A1* 5/2015 Hara ..... B41J 2/16544 347/33
2016/0185121 A1* 6/2016 Somete ..... B41J 2/16535 347/33
2017/0096008 A1* 4/2017 Nakagawa ..... B41J 2/16535

FOREIGN PATENT DOCUMENTS

JP 2011207235 A 10/2011

* cited by examiner

*Primary Examiner* — Anh T Vo
(74) *Attorney, Agent, or Firm* — Canon U.S.A., Inc. IP Division

(57) ABSTRACT

A liquid discharge apparatus includes a liquid discharge head including a discharge port configured to discharge liquid and a discharge port surface provided with the discharge port. A head cleaning member including a contact portion contacts the discharge port surface, and is configured to cause the contact portion to contact the discharge port surface and to move relative to the discharge port surface in order to clean adherents attached to the discharge port surface. The discharge port includes a plurality of protrusion portions extending toward a discharge port inner side. The contact portion includes a fiber, and the fiber in the contact portion includes a portion having a size greater than a minimum protrusion distance among protrusion distances between the protrusion portions.

24 Claims, 18 Drawing Sheets

CROSS SECTION A-A'

CROSS SECTION α-α'

CROSS SECTION B-B'

CROSS SECTION β-β'

CROSS SECTION C-C'

CROSS SECTION γ-γ'

CROSS SECTION D-D'

CROSS SECTION E-E'

CROSS SECTION F-F'

CROSS SECTION G-G'

CROSS SECTION H-H'

CROSS SECTION I-I'

CROSS SECTION J-J'

CROSS SECTION K-K'

CROSS SECTION L-L'

CROSS SECTION M-M'

CROSS SECTION N-N'

CROSS SECTION O-O'

CROSS SECTION P-P'

CROSS SECTION Q-Q'

CROSS SECTION R-R'

LIQUID DISCHARGE APPARATUS AND CLEANING METHOD FOR LIQUID DISCHARGE HEAD

BACKGROUND OF DISCLOSURE

Field of the Disclosure

The present disclosure relates to a liquid discharge apparatus that discharges liquid.

Description of the Related Art

In recent years, it has been desired that a liquid discharge apparatus such as an inkjet recording apparatus configured to discharge ink employs a discharge port having a shape that reduces or eliminates satellite droplets of microdroplets discharged together with main droplets, as a demand is increasing for higher image quality and printing quality enhancement. Japanese Patent Application Laid-Open No. 2011-207235 discusses a liquid discharge apparatus including a discharge port with a protrusion portion that protrudes toward a discharge port inner side. With such a discharge port, the liquid discharge apparatus can suppress satellite droplets.

Moreover, the use of high performance ink with a high solid content has been desired as a demand such as enhancement of the recording speed is increasing. Since ink with the high solid content has a small amount of moisture, such ink dries faster when discharged on a recording medium. However, the ink with the high solid content solidifies more easily on a discharge port surface of a liquid discharge head. Consequently, a cleaning mechanism is necessary to scrape the solidified ink.

A cleaning method using a rubber blade and a cleaning method using fibers are known as the cleaning mechanisms. In the cleaning method using fibers, ink is absorbed in the fibers. Thus, color mixture of liquid barely occurs in comparison with the cleaning method using the rubber blade. Moreover, since ink that has solidified is scraped by the fibers, cleaning performance can be enhanced.

In the cleaning method using fibers, the fiber may enter the inside of the discharge port. If this cleaning method is applied to clean a discharge port surface having a protrusion portion discussed in Japanese Patent Application Laid-Open No. 2011-207235, the fiber enters the inside of a discharge port and is caught on the protrusion portion. This may damage the protrusion portion. If the protrusion portion is damaged, satellite droplets increase or a landing point of droplets is changed, which may affect image quality and printing quality.

SUMMARY OF THE INVENTION

The present disclosure is directed to suppression of damage caused to a protrusion portion of a discharge port including the protrusion portion in cleaning a discharge port surface by using fibers.

According to an aspect of the disclosure, a liquid discharge apparatus includes a liquid discharge head including a discharge port configured to discharge liquid and a discharge port surface provided with the discharge port, and a head cleaning member including a contact portion that contacts the discharge port surface, and configured to cause the contact portion to contact the discharge port surface and to move relative to the discharge port surface in order to clean adherents attached to the discharge port surface. The discharge port includes a plurality of protrusion portions extending toward a discharge port inner side, the contact portion includes a fiber, and the fiber in the contact portion includes a portion having a size greater than a minimum protrusion distance among protrusion distances between the protrusion portions.

Further features and aspects of the disclosure will become apparent from the following description of example embodiments with reference to the attached drawings.

DESCRIPTION OF THE EMBODIMENTS

Hereinafter, a liquid discharge apparatus according to each of the example embodiments is described with reference to the drawings. The liquid discharge apparatus that discharges liquid such as ink and is described in the present disclosure can be applied to an apparatus such as a printer, a copy machine, a facsimile including a communication system, and a word processor including a printer unit. Moreover, the liquid discharge apparatus can be applied to an industrial recording apparatus that is combined with various processing apparatuses. For example, the liquid discharge apparatus can be used in biochip manufacturing, electronic circuit printing, semiconductor substrate manufacturing, and a three dimensional (3D) printer. Moreover, although each of the example embodiments employs a thermal method for discharging liquid by generating bubbles using a heating element, the present disclosure can be applied to a liquid discharge head in which a liquid discharge method such as a piezoelectric method and other various liquid discharge methods is employed. Moreover, the present disclosure can be applied to a page-wide-type liquid discharge head having a length corresponding to a width of a recording medium, and a serial-type liquid discharge head that performs a recording operation while performing a scanning operation on a recording medium.

In addition, in the present disclosure, a fibriform material is used for a cleaning mechanism. However, a rubber material or a porous member can be used in combination with the fibriform cleaning mechanism. According to the present disclosure, a discharge port surface can be cleaned by pressing with the fibers. However, the discharge port surface is more suitably cleaned by a relative movement of fibers or a liquid discharge head after the fibers are pressed against the discharge port surface.

A liquid discharge head according to a first example embodiment is hereinafter described with reference to FIGS. 1 through 10. The present example embodiment is described on the assumption that a page-wide-type head is used as a liquid discharge head. As mentioned above, the present disclosure is not limited to the page-wide-type head.

(Liquid Discharge Apparatus)

Figure 1:
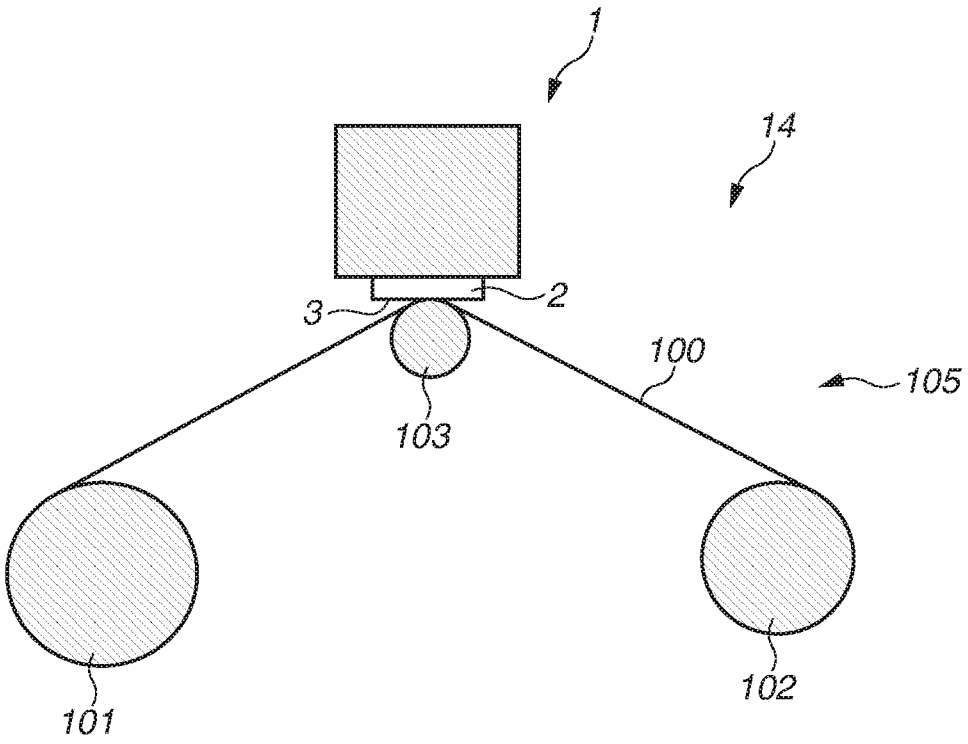
FIG. 1 is a schematic diagram of an example liquid discharge apparatus.

FIG. 1 is a schematic diagram of a liquid discharge apparatus 14 according to the present example embodiment. The liquid discharge apparatus 14 includes a liquid discharge head 1 for discharging liquid such as ink droplets, and a cleaning mechanism 105 for cleaning a discharge port surface 3 of the liquid discharge head 1. In FIG. 1, components other than the liquid discharge head 1 and the cleaning mechanism 105 are omitted.

(Liquid Discharge Head)

Figure 2:
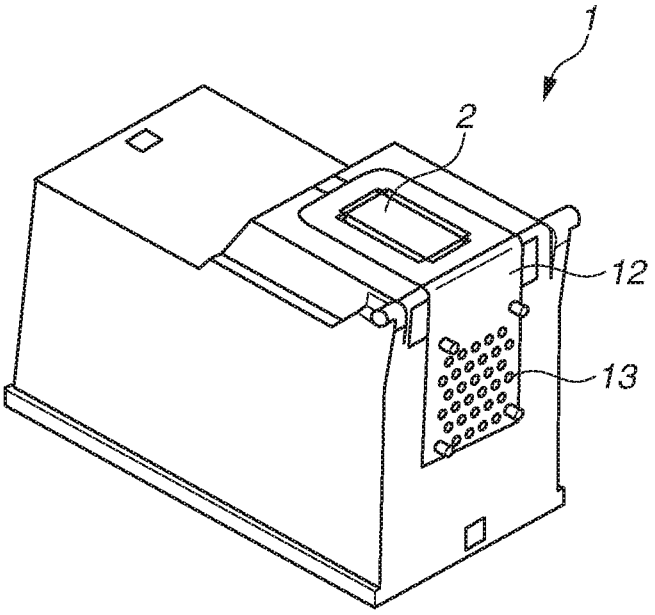
FIG. 2 is a perspective view of an example liquid discharge head.

FIG. 2 is a perspective view of the liquid discharge head 1 according to the present example embodiment. The liquid discharge head 1 includes a recording element substrate 2, and an electrical wiring member 12 provided with a pad portion 13. The pad portion 13 receives electric power and signals from a liquid discharge apparatus body, and the electrical wiring member 12 electrically connects the recording element substrate 2 to the pad portion 13.

Figure 3:
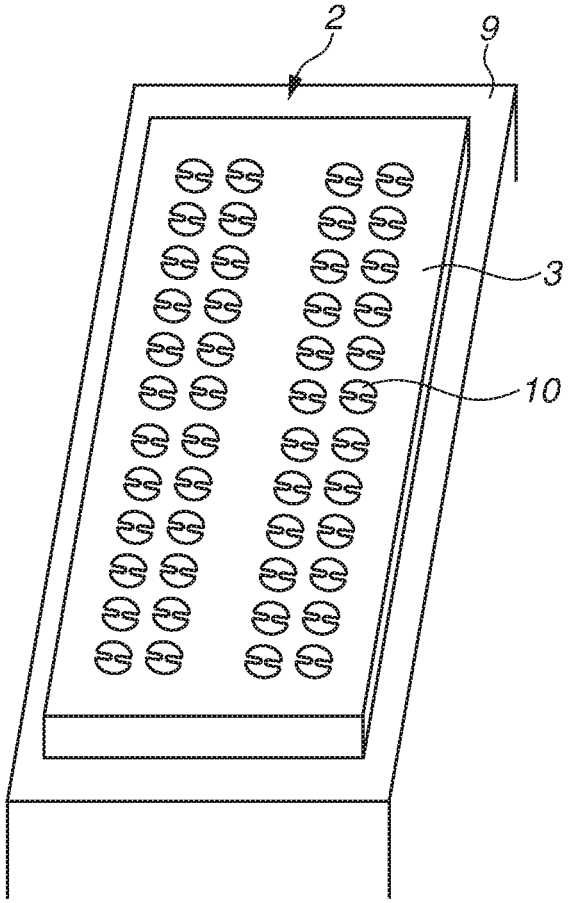
FIG. 3 is a perspective view of the vicinity of a recording element substrate.

FIG. 3 is a perspective view of the vicinity of the recording element substrate 2. The recording element substrate 2 includes a plurality of discharge ports 10 and the discharge port surface 3 on which the plurality of discharge ports 10 is formed. The recording element substrate 2 is supported by a supporting member 9. Ink droplets are discharged from the discharge port 10 to record an image or a character. In FIG. 3, the electrical wiring member 12 and the pad portion 13 are omitted.

Figure 4A:
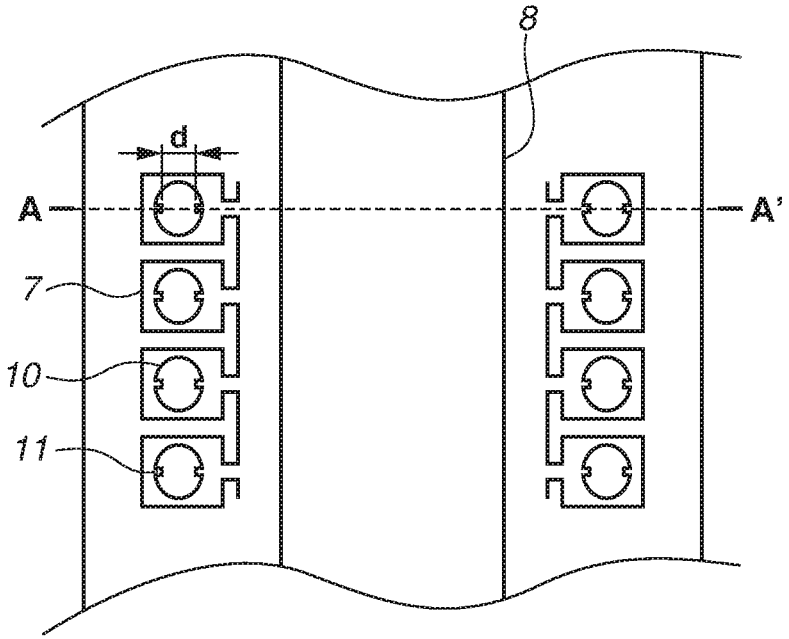
FIG. 4A is a schematic diagram of a discharge port and the vicinity thereof.
Figure 4B:
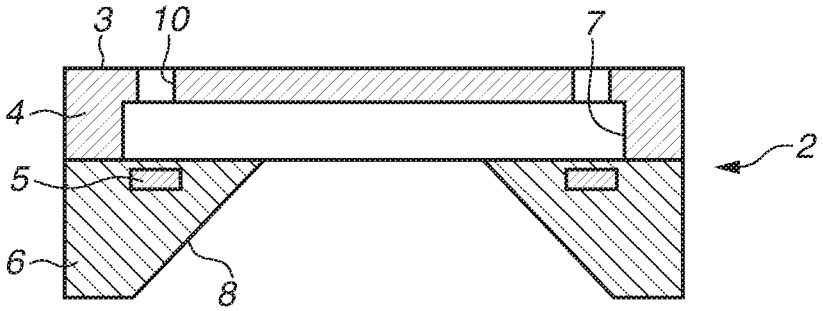
FIG. 4B is a sectional view along the line A-A' of FIG. 4A.

FIGS. 4A and 4B are diagrams each illustrating the vicinity of the discharge port 10. FIG. 4A is a top view, and FIG. 4B is a sectional view along the line A-A' of FIG. 4A. The recording element substrate 2 includes a discharge port forming member 4, a heat resistance element 5, and a substrate 6. A channel wall 7 and the discharge port 10 are formed by the discharge port forming member 4. The discharge port forming member 4 is, for example, made from resin. In the top view of FIG. 4A, since the vicinity of the discharge port 10 is viewed from above in a state where one portion of the discharge port forming member 4 is seen through, a contour of a supply port 8 is illustrated.

As illustrated in FIG. 4A, the discharge port 10 includes a protrusion portion 11 extending toward the discharge port inner side, and there is a space (hereinafter referred to as a protrusion distance) between protrusion portions 11. In FIG. 4, a distance d (hereinafter referred to as a minimum protrusion distance) indicates a minimum distance out of protrusion distances between protrusion portions 11. The protrusion distance is taken also in a thickness direction of the protrusion portion 11. That is, if distances vary with respect to the thickness direction, a shortest distance among the distances can be considered as a minimum protrusion distance. For example, if a portion positioned in the center of the protrusion portion 11 in the thickness direction extends most toward the inner side of the discharge port 10, a distance between the portions positioned in the center is a minimum protrusion distance d. Moreover, a protrusion distance between two protrusion portions 11 is not limited to a distance between tip portions of protrusion portions 11. A protrusion distance can be defined between portions other than the tip portions.

The heat resistance element 5 is formed in a position opposite the discharge port 10. Application of voltage to the heat resistance element 5 instantly vaporizes ink on the heat resistance element 5, and bubbles are generated, so that ink droplets are discharged from the discharge port 10.

(Cleaning Mechanism)

Figure 5A:
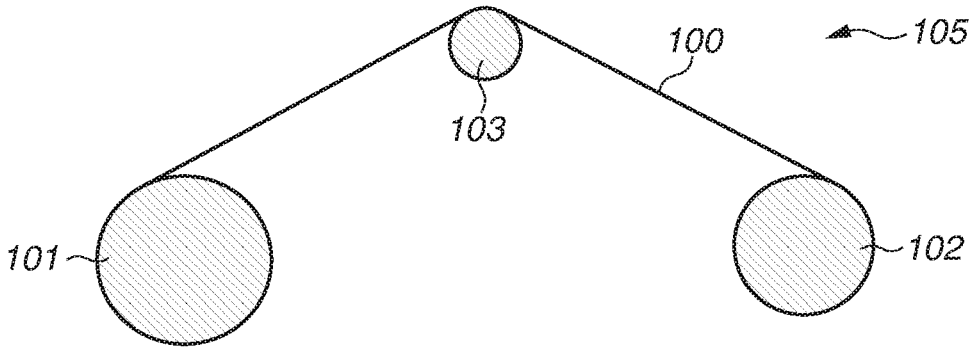
FIG. 5A is a schematic diagram of a cleaning mechanism.
Figure 5B:
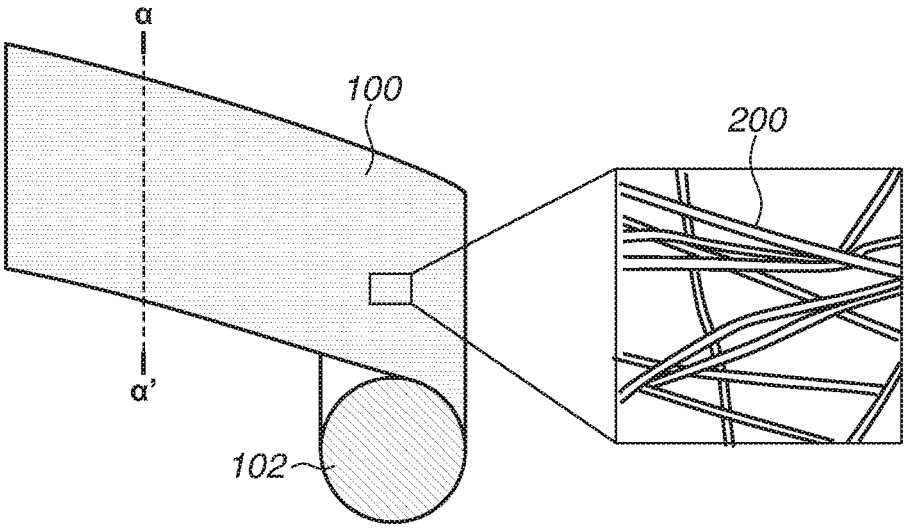
FIG. 5B is an enlarged partial view of the cleaning mechanism.
Figure 5C:
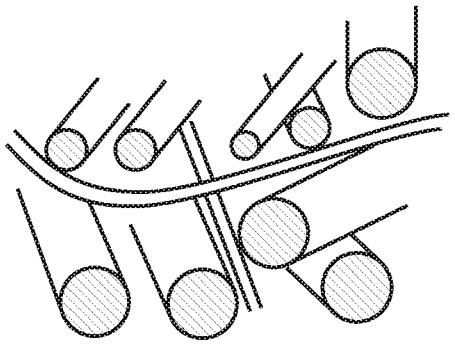
FIG. 5C is a sectional view along the line α-α' of FIG. 5B.

FIGS. 5A, 5B, and 5C are schematic diagrams of the cleaning mechanism 105 according to the present example embodiment. The cleaning mechanism 105 cleans the discharge port surface 3 based on a state of the discharge port surface 3 or the number of printing sheets. FIG. 5A is a schematic diagram of the cleaning mechanism 105, FIG. 5B is a schematic diagram of a head cleaning member 100, and FIG. 5C is a sectional view along the line α-α' of FIG. 5B.

The head cleaning member 100 including a fiber member made of a fiber 200 is connected to a support roller 101 and a take-up roller 102. In a cleaning operation, the head cleaning member 100 contacts the discharge port surface 3 using a pressing roller 103, and each roller is driven to scrape adherents adhering to the discharge port surface 3. The pressing roller 103 is moved over the discharge port surface 3 to clean the entire discharge port surface 3.

The head cleaning member 100 of the present example embodiment is nonwoven fabric as illustrated in FIG. 5B, and includes fibers 200 that are provided in an irregular manner. Accordingly, the fibers 200 can contact adherents from various directions, and thus a high removal efficiency can be achieved. The fibers 200 can have sizes φ that are not necessarily uniform throughout the head cleaning member 100 and have variation in size p as illustrated in FIG. 5C, as long as the fiber 200 which contacts the discharge port surface 3 has a portion having a size greater than a minimum protrusion distance d.

In the present disclosure, fibers are not necessarily provided in the entire area of the head cleaning member 100. The fiber 200 may be at least provided in a portion that contacts the discharge port surface 3. Moreover, the head cleaning member 100 is not necessarily nonwoven fabric. The head cleaning member 100 can be woven fabric. Moreover, the head cleaning member 100 can be a collection of short fibers, or can be formed by entwining a single long fiber. Moreover, the fiber 200 can be a single pseudo fiber that is formed by entwining a plurality of fibers. In other words, a minimum-sized fiber that can enter the inside of the discharge port 10 is regarded as the fiber 200. Thus, even if a plurality of fibers is entwined together to form a single pseudo fiber, the entwined fibers may become loose in an end portion, and each loose fiber may enter the inside of the discharge port 10. In such a case, each loose fiber is consider as the fiber 200.

Figure 6:
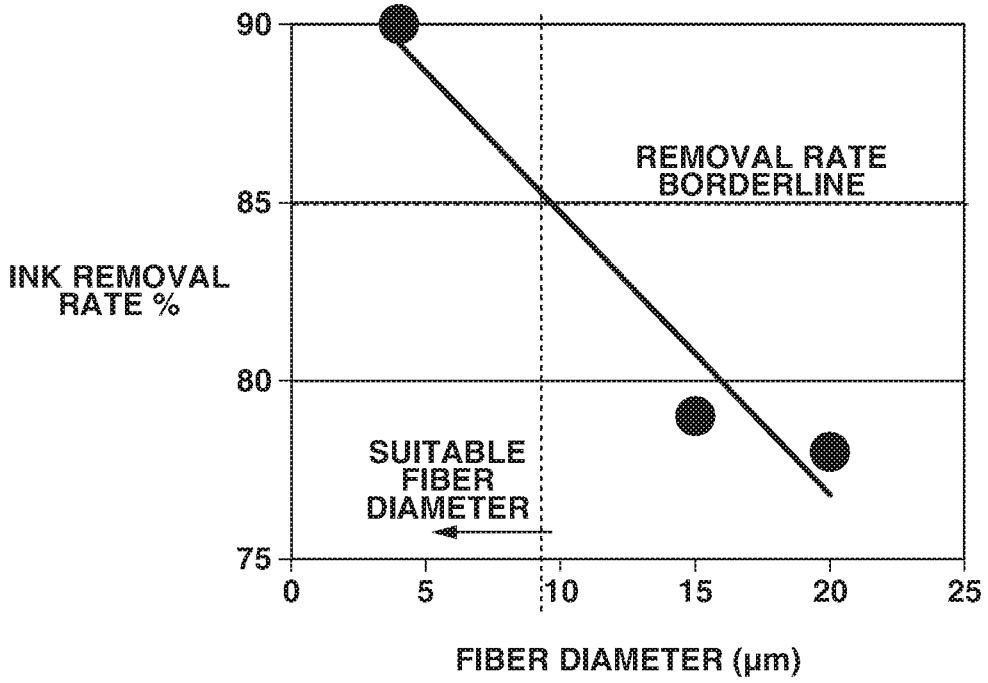
FIG. 6 is a graph of a pigment ink removal rate with respect to each fiber diameter.

FIG. 6 is a graph of a pigment ink removal rate measured by using nonwoven fabric. In FIG. 6, a horizontal axis indicates a fiber diameter [μm], while a vertical axis indicates an ink removal rate [%]. Pigment ink including resin was sprayed to a surface of a water-repellent coated substrate to be attached to the substrate surface, and the pigment ink on the substrate surface was heated for 10 minutes at a temperature of 70 degrees to solidify the pigment ink. The substrate surface was wiped once with a pressure of 15 kPa at a speed of 1 inch/sec. An area of the pigment ink solidified on the substrate surface was set as an initial value, and an area of the pigment ink remaining on the substrate relative to the initial value after the substrate surface was wiped once under the above conditions was set as an ink removal rate [%]. An area of pigment ink was calculated from an image. For example, if a half of pigment ink remains after the substrate surface is wiped once, an ink removal rate is 50%. In the measurement, a size φ of the fiber 200 was varied as a measurement parameter.

As illustrated in FIG. 6, the smaller the fiber diameter, the higher the ink removal rate. An ink removal rate is desirably 85% or higher. More preferably, an ink removal rate is 90% or higher. In the present example embodiment, since the fiber 200 having a size φ of approximately 5 μm is used, adequate cleanability can be obtained.

(Discharge Port and Protrusion Portion)

Figure 7A:
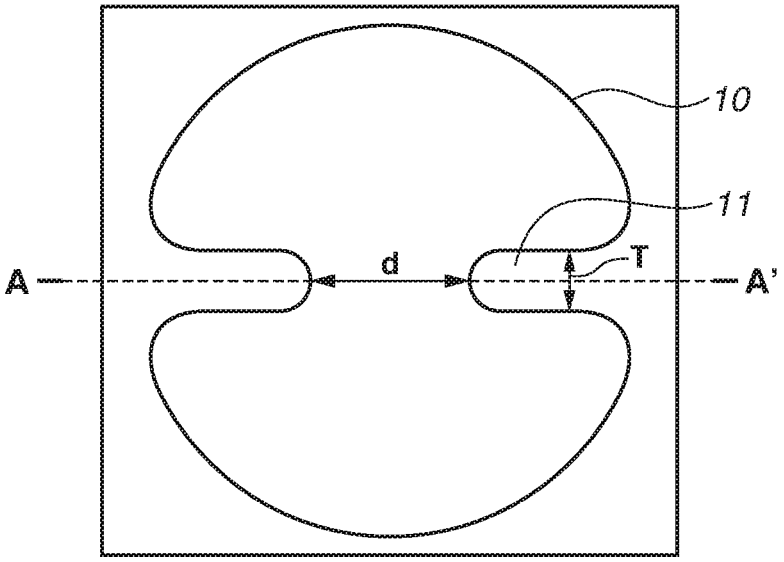
FIG. 7A is a diagram of one example of the discharge port.
Figure 7B:
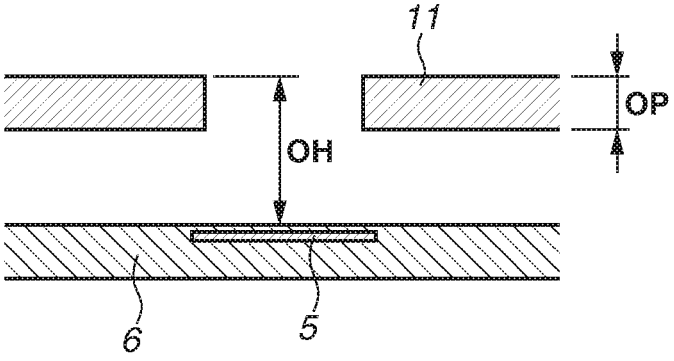
FIG. 7B is a sectional view along the line A-A' of FIG. 7A.

FIGS. 7A and 7B are diagrams illustrating one example of the discharge port 10. An area (hereinafter referred to as an inter-protrusion area) formed by protrusion portions 11 has a fluid resistance higher than that in an area in which a protrusion portion is not formed. Accordingly, in the inter-protrusion area, a liquid film is retained/formed, and a liquid column is formed. Thus, the liquid column is cut from ink inside the ink discharge port in an early stage, and discharged as droplets. This shortens a droplet tail of the discharged droplet, thereby preventing satellite droplets.

A diameter of the discharge port 10 is, for example, between 5 μm and 30 μm. In the present example embodiment, the discharge port 10 has a diameter of 21 μm. In FIG. 7A, for example, a protrusion distance d is 7.7 μm, and a size T of the protrusion portion 11 is 4 μm. In FIG. 7B, for example, a distance OH is 22 μm, and a thickness OP of the protrusion portion 11 is 4 μm.

(Relation between Fiber and Protrusion at Time of Cleaning)

Figure 8A:
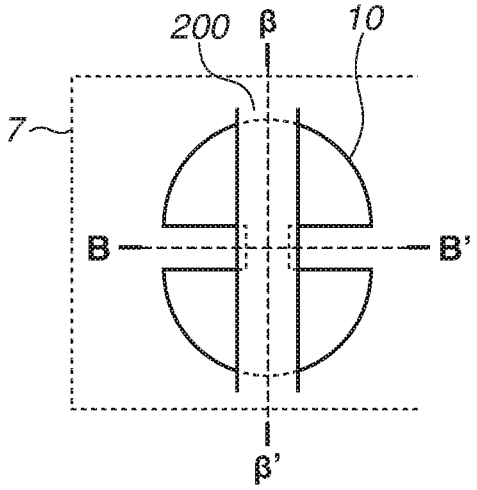
FIG. 8A is a top view of a discharge port and a fiber according to a first example embodiment.
Figure 8B:
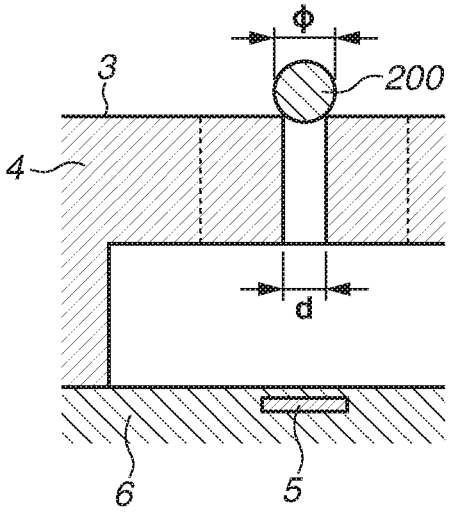
FIG. 8B is a sectional view along the line B-B' of FIG. 8A.
Figure 8C:
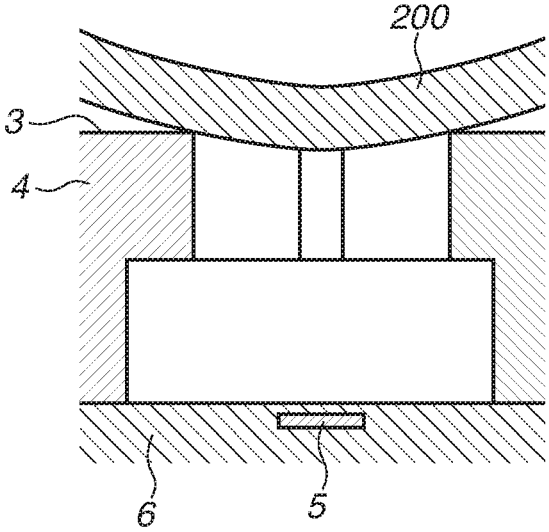
FIG. 8C is a sectional view along the ling β-β' of FIG. 8A.
Figure 9A:
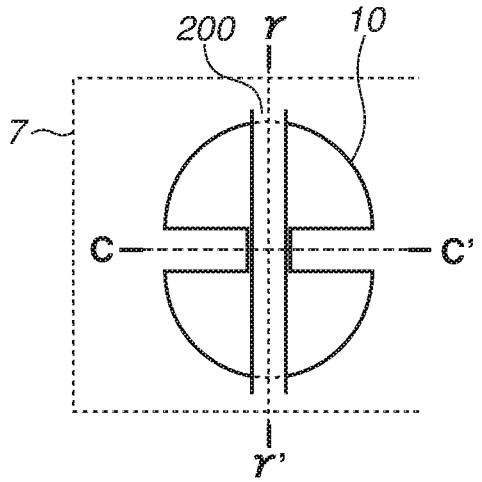
FIGS. 9A, 9B, and 9C are comparison diagrams relative to FIGS. 8A, 8B, and 8C, respectively.
Figure 9B:
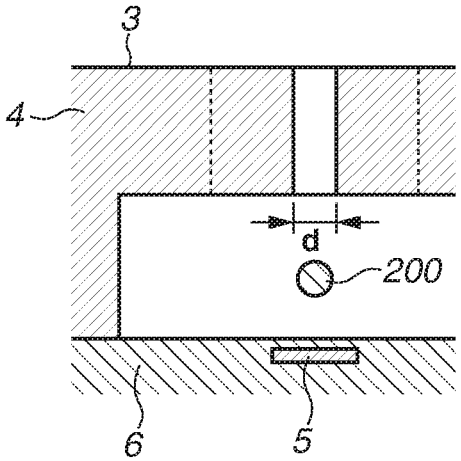
Figure 9C:
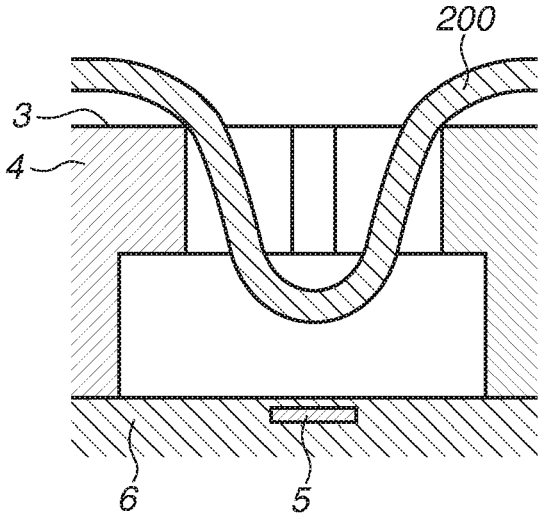

FIGS. 8A, 8B, and 8C are diagrams each illustrating a positional relation between the discharge port 10 and the fiber 200 included in the head cleaning member 100 at the time of cleaning according to the present example embodiment. FIGS. 8A, 8B, and 8C are conceptual diagrams according to the present example embodiment to describe a relation between the fiber 200 and the protrusion portion 11 at the time of cleaning. Although only one fiber 200 is illustrated in each of FIGS. 8A, 8B, and 8C, the present disclosure is not limited to one fiber. A plurality of fibers can be present near the discharge port. FIGS. 9A, 9B, and 9C are comparison diagrams relative to FIGS. 8A, 8B, and 8C respectively.

Each of FIGS. 8A, 8B, and 8C illustrates a case where a size p of the fiber 200 is greater than a minimum protrusion distance d. FIG. 8A is a top view of the fiber 200 and the discharge port 10 including the protrusion portion 11 FIG. 8B is a sectional view along the line B-B' of FIG. 8A, and FIG. 8C is a sectional view along the line β-β' of FIG. 8A.

Each of FIGS. 9A, 9B, and 9C illustrates a case where a size φ of a fiber 200 is smaller than a minimum protrusion distance d as a comparison diagram relative to the present example embodiment. FIG. 9A is a top view of the fiber 200 and the discharge port 10 including the protrusion portion 11. FIG. 9B is a sectional view along the line C-C' of FIG. 9A, and FIG. 9C is a sectional view along the line γ-γ' of FIG. 9A.

In FIGS. 9A, 9B, and 9C, since a size q of the fiber 200 is smaller than a minimum protrusion distance d, the fiber 200 may enter the inside of the discharge port 10. The fiber 200, which has entered the inside of the discharge port 10 at the time of cleaning, may be caught on the protrusion portion 11. This may damage the protrusion portion 11. On the other hand, in the present disclosure, a size φ of the fiber 200 is greater than a minimum protrusion distance d. If a size φ of the fiber 200 is greater than a minimum protrusion distance d as illustrated in FIGS. 8A, 8B, and 8C of the present example embodiment, the fiber 200 can be prevented from entering the inside of the discharge port 10. As illustrated in FIG. 8B which is the sectional view alone the line B-B' of FIG. 8A, although the fiber 200 partially enters the inside of the discharge port 10, the entire fiber 200 does not easily enter the inside of the discharge port 10. Hence, the fiber 200 is not easily caught on the protrusion portion 11, and damage to the protrusion portion 11 can be prevented.

Figure 10:
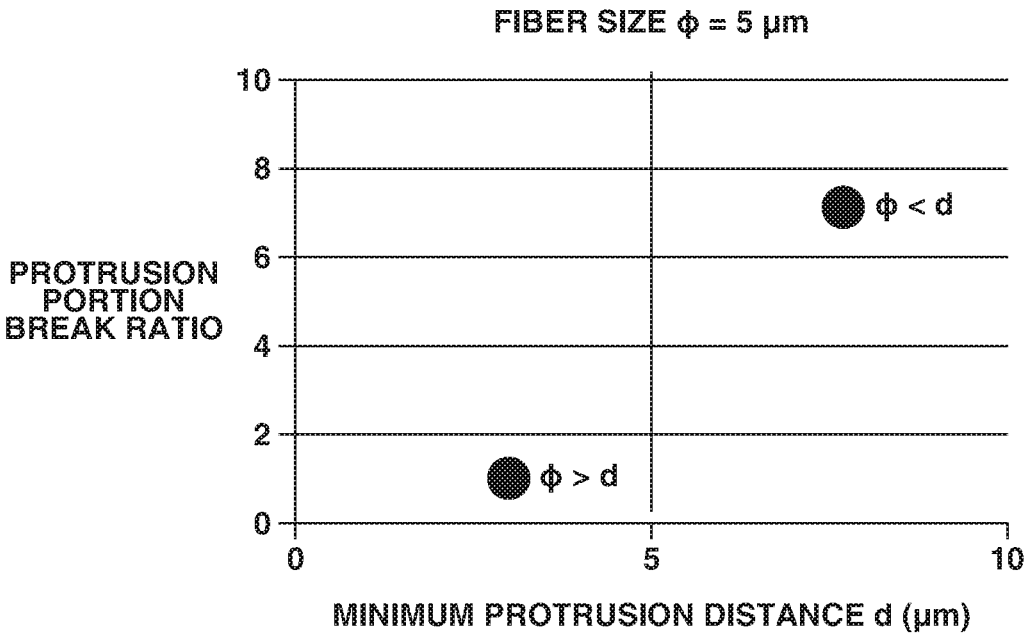
FIG. 10 is a diagram of a result of measuring a number of breakages of a protrusion portion.
Figure 11A:
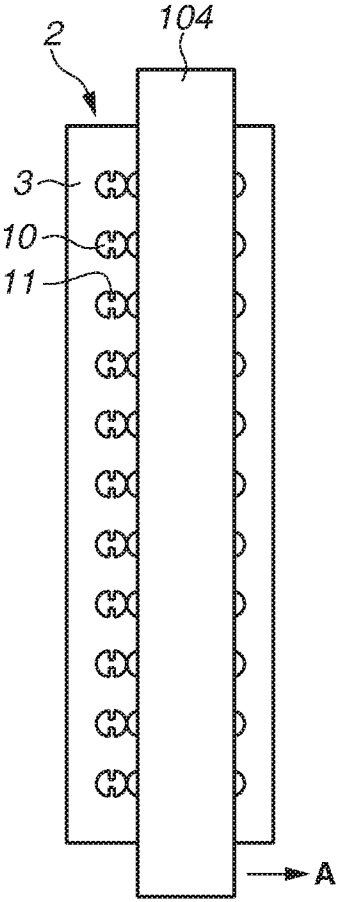
FIG. 11A is a schematic diagram illustrating a case where an angle between an orientation in which the protrusion portion extends and a wiping direction is a right angle.
Figure 11B:
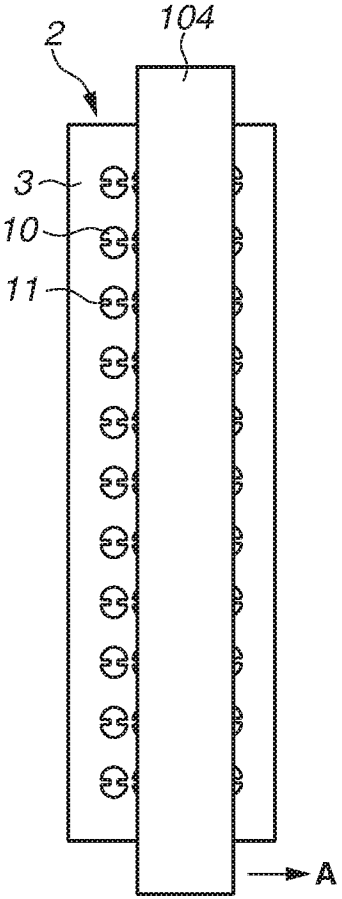
FIG. 11B is a schematic diagram illustrating a case where an angle between an orientation in which the protrusion portion extends and a wiping direction is parallel.
Figure 11C:
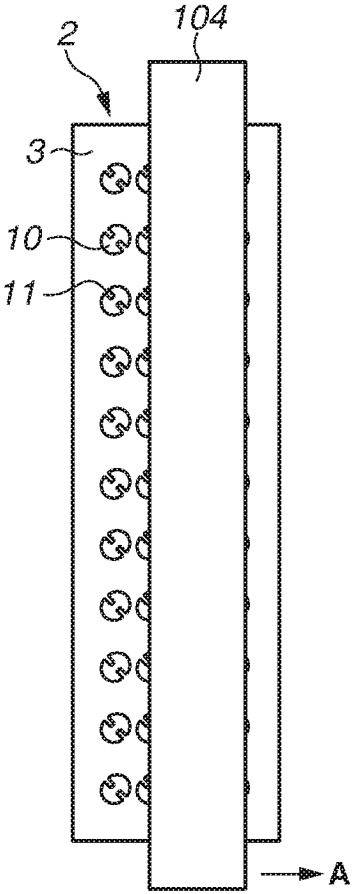
FIG. 11C is a schematic diagram illustrating a case where an angle between an orientation in which the protrusion portion extends and a wiping direction is 45 degrees.
Figure 11D:
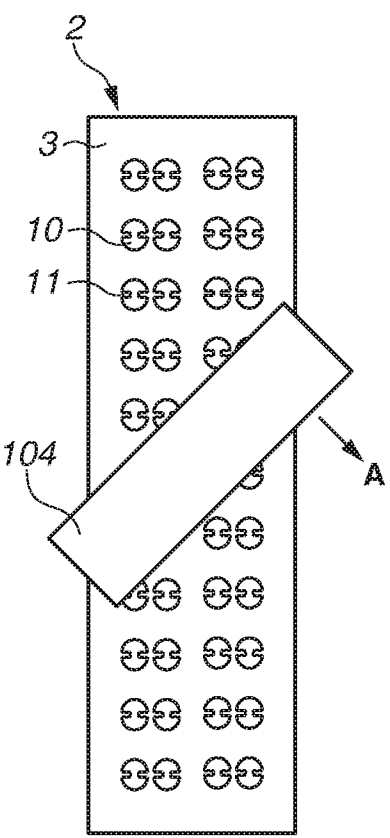
FIG. 11D is a schematic diagram illustrating a case where an angle between an orientation in which the protrusion portion extends and a wiping direction is 45 degrees.

FIG. 10 illustrates a result of measurement of the number of breakages of the protrusion portion 11 when the discharge port surface 3 was cleaned by nonwoven fabric. Herein, the measurement was carried out where a size φ of a fiber of the nonwoven fabric was 5 μm, and a minimum protrusion distance d was 3 μm or 8 μm. Moreover, a ratio was used to indicate the number of breakages. A result of measurement obtained where the minimum protrusion distance d was 3 μm was taken as 1, and the number of breakages was expressed based on a ratio to the result of 1. If a protrusion distance is shorter, a protrusion becomes longer. Consequently, a mechanical strength is decreased. However, a fiber can be prevented from entering an inter-protrusion area. Accordingly, as illustrated in FIG. 10, a ratio of breakages of the protrusion portion 11 was decreased. There was a sevenfold difference in break ratio, depending on whether a distance between the protrusions was greater or less than a size p of the fiber.

In the present example embodiment, diameters of fibers included in the head cleaning member 100 are uniform. However, fibers can have variation in diameter as described above. If there is variation in fiber diameter, an average value of size of each fiber 200 per unit length is desirably greater than a minimum protrusion distance d. More desirably, 90% or more of the fiber 200 has a diameter greater than the minimum protrusion distance d. The phrase "90% or more" used herein represents a case in which a proportion of a portion having a size greater than a minimum protrusion distance d to a length of a single long fiber is 90% or more when all of fibers in a portion that contacts the discharge port surface 3 are connected to form the single long fiber.

(Relation between Orientation in Which Protrusion Extends and Wiping Direction)

FIGS. 11A, 11B, 11C and 11D are diagrams each illustrating a relation between an orientation in which the protrusion portion 11 extends, and a wiping direction. The head cleaning member 100 includes a contact portion 104 that contacts the discharge port surface 3. The head cleaning member 100 cleans the discharge port surface 3 in such a manner that the contact portion 104 moves in a direction indicated by an arrow A illustrated in each of FIGS. 11A through 11D. In FIGS. 11A, 11B, 11C, and 11D, angles between an orientation in which the protrusion portion 11 extends, and a wiping direction are respectively a right angle, parallel, 45 degrees, and 45 degrees. The orientation in which the protrusion portion 11 extends and the wiping direction are desirably parallel. If the orientation and the wiping direction are parallel, an orientation in which a load is applied to the protrusion portion 11 and the direction in which the protrusion portion 11 extends are substantially the same. Thus, a stress to be applied to a root of the protrusion portion 11 is reduced. Moreover, if an angle between an orientation in which the protrusion portion 11 extends and a wiping direction is 45 degrees or less, a vertical force to be applied to the protrusion portion 11 becomes $1/\sqrt{2}$ times or less. Hence, an effect of preventing damage to the protrusion portion 11 can be enhanced. The present disclosure is not limited to the relation between the orientation in which the protrusion portion 11 extends, and the wiping direction illustrated in FIGS. 11A through 11D.

(Ink with High Solid Content)

A suitable solid content in ink for increasing recording speed is between 5 weight % and 30 weight %, for example. Herein, a solid content in ink includes emulsion such as pigment, resin, and high molecular polymer. However, when ink with a high solid content is used, the ink is caused to solidify more easily near the periphery of the discharge port 10, and solidification of ink causes a discharge failure more easily. According to the present disclosure, high-solid content ink solidified on a discharge port surface can be cleaned, and ink with a high solid content can be used in a liquid discharge apparatus.

Figure 12A:
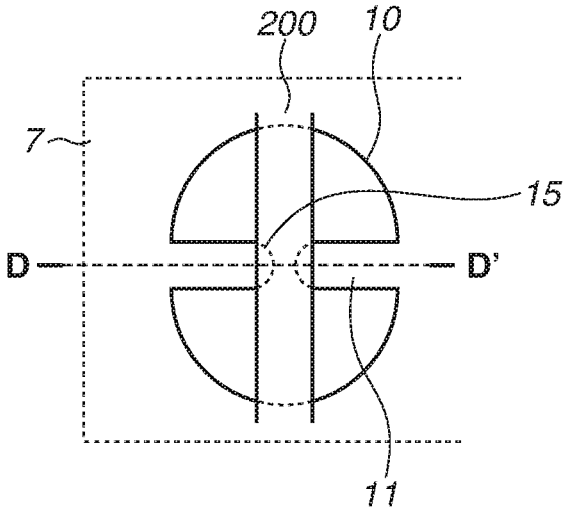
FIG. 12A is a top view of a discharge port and a fiber according to a second example embodiment.
Figure 12B:
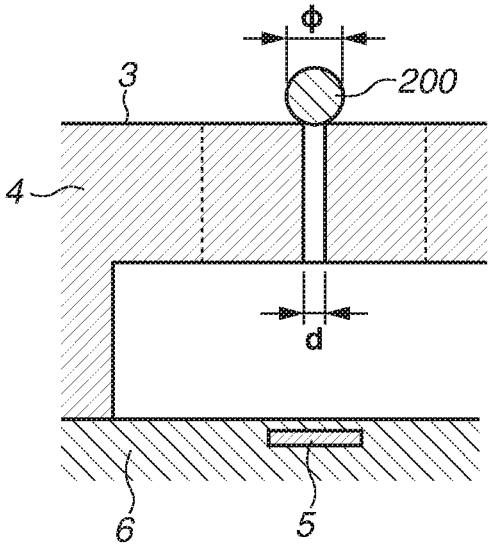
FIG. 12B is a sectional view along the line D-D' of FIG. 12A.

A second example embodiment is hereinafter described. FIGS. 12A and 12B are schematic diagrams of a discharge port 10 according to the present example embodiment. In the present example embodiment, as illustrated in FIG. 12A, a tip portion of a protrusion portion 11 in the discharge port 10 has a semicircular shape. Components and configurations that are similar to the above first example embodiment will be given the same reference numerals as above and description thereof will be omitted. Each of FIGS. 12A and 12B illustrates a fiber 200 and a protrusion portion 11 with the tip portion that has a semicircular shape. FIG. 12A is a top view of the fiber 200 and the protrusion portion 11, and FIG. 12B is a sectional view along the line D-D' of FIG. 12A.

In the present example embodiment, a tip portion 15 is semicircle having a curvature of 2 μm, for example. In the present example embodiment, a minimum protrusion distance d is a distance between tip portions of protrusion portions 11. The tip portion 15 of the protrusion portion 11 has such a semicircular shape, so that a possibility that a fiber 200 is caught on an edge portion of the protrusion portion 11 can be reduced. Therefore, an effect of preventing damage to the protrusion portion 11 is enhanced.

A third example embodiment is hereinafter described. FIGS. 13A, 13B, and 14A through 14F are schematic diagrams of a discharge port 10 according to the present example embodiment. In the present example embodiment, the discharge port 10 includes three or more protrusion portions 11 as illustrated in FIGS. 13A, 13B, and 14A through 14F. Components and configurations that are similar to the above first example embodiment will be given the same reference numerals as above and description thereof will be omitted.

Figure 13A:
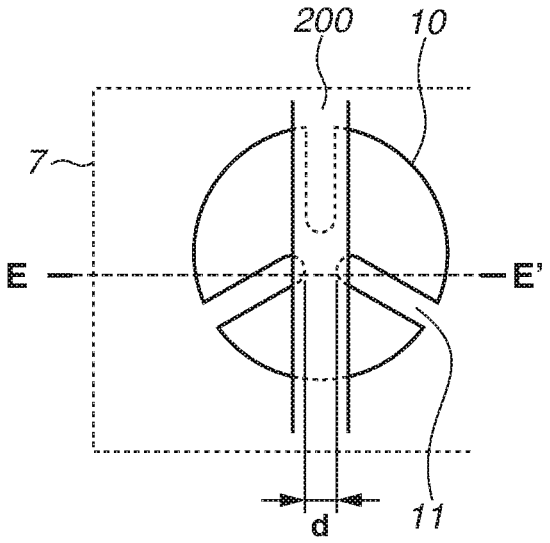
FIG. 13A is a top view of a discharge port and a fiber according to a third example embodiment.
Figure 13B:
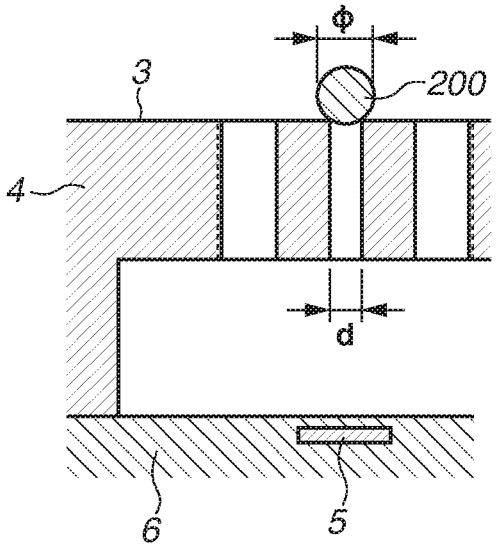
FIG. 13B is a sectional view along the line E-E' of FIG. 13A.

FIGS. 13A and 13B illustrate a fiber 200 and a discharge port 10 including three protrusion portions 11. FIG. 13A is a top view of the fiber 200 and the discharge port 10, and FIG. 13B is a sectional view along the line E-E' of FIG. 13A. Since the discharge port 10 includes three protrusion portions 11, a proportion of the protrusion portions 11 to the discharge port 10 increases. Moreover, the protrusion portions 11 extend toward the inside of the discharge port 10 from not only one direction but also from multiple directions. As a result, an entry of the fiber 200 into the discharge port inner side is decreased, and an effect of preventing damage to the protrusion portion 11 is enhanced.

Figure 14A:
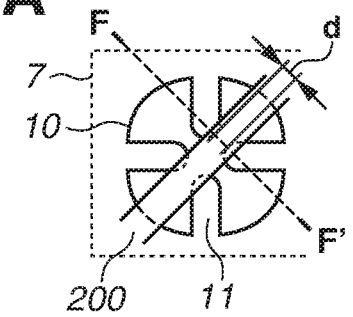
FIG. 14A is a top view of a discharge port and a fiber according to the third example embodiment.
Figure 14C:
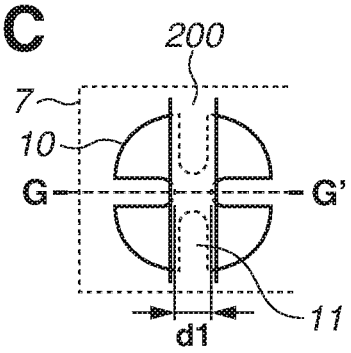
FIG. 14C is a top view of a discharge port and a fiber according to the third example embodiment.
Figure 14B:
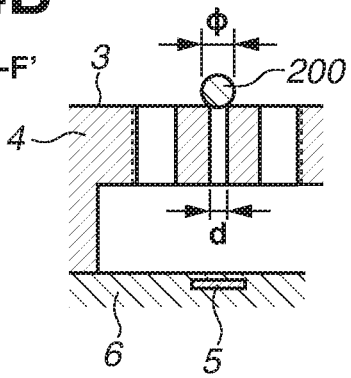
FIG. 14B is a sectional view along the line G-G' of FIG. 14A.
Figure 14D:
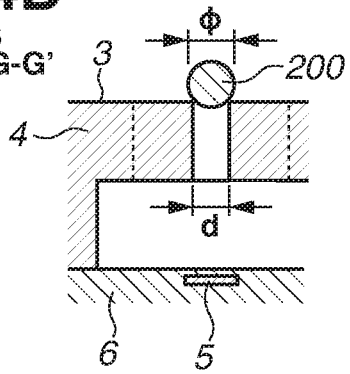
FIG. 14D is a sectional view along the line F-F' of FIG. 14C.
Figure 14E:
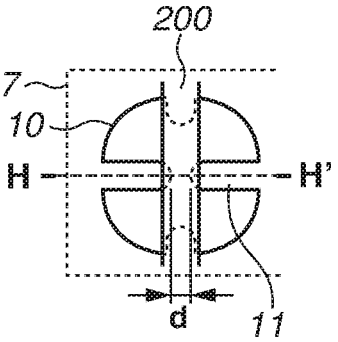
FIG. 14E is a top view of a discharge port and a fiber according to the third example embodiment.
Figure 14F:
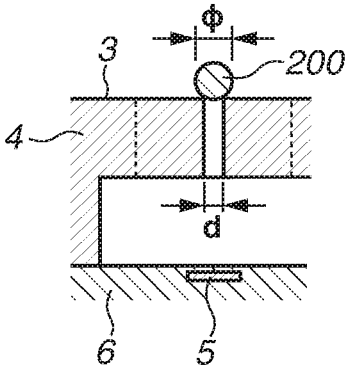
FIG. 14F is a sectional view along the line H-H' of FIG. 14E.

FIGS. 14A through 14F illustrate a fiber 200 and a discharge port 10 including four protrusion portions 11. FIGS. 14A, 14C, and 14E are top views each illustrating the fiber 200 and the discharge port 10. FIGS. 14B, 14D, and 14F are sectional views of FIGS. 14A, 14C, and 14F, respectively. If the discharge port 10 includes four or more protrusion portions 11, there is a plurality of protrusion distances such as a protrusion distance between opposite protrusion portions 11 and a protrusion distance between adjacent protrusion portions 11.

FIGS. 14A and 14B are schematic diagrams in a case where a minimum protrusion distance d is a protrusion distance between adjacent protrusion portions. Even in such a case, by increasing a size φ of the fiber 200 to be greater than the minimum protrusion distance d, an entry of fiber 200 into the discharge port can be decreased. As illustrated in FIGS. 14E and 14F, the protrusion portions 11 can be different in their length. Also in such a case, by increasing the size φ of the fiber 200 to be greater than a minimum protrusion distance d, the fiber can be prevented from entering the discharge port.

FIGS. 14C and 14D are schematic diagrams in a case where the size of a fiber 200 is greater than a protrusion distance dl that is the maximum size among protrusion distances between tip portions of the protrusion portions. The size p of the fiber 200 is greater than the maximum protrusion distance dl, so that entries of the fibers into the inside of the discharge port from an inter-protrusion area can be prevented, and damage to the protrusion portion can be further prevented.

Figure 15A:
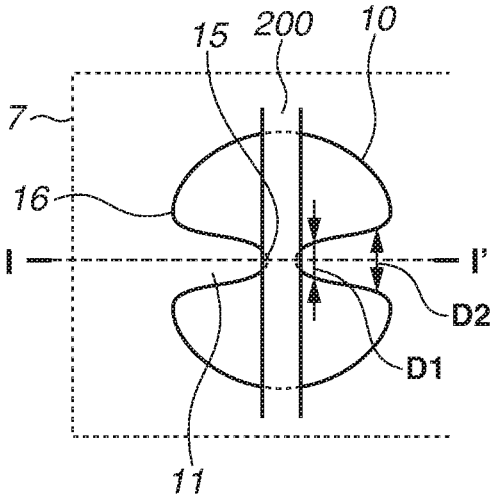
FIG. 15A is a top view of a discharge port and a fiber according to a fourth example embodiment.
Figure 15B:
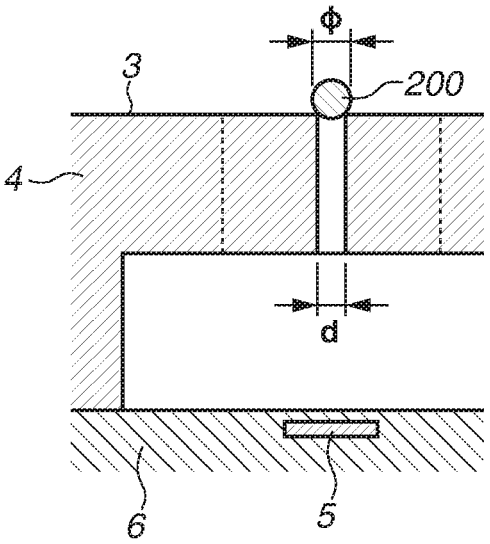
FIG. 15B is a sectional view along the line I-I' of FIG. 15A.

A fourth example embodiment is hereinafter described. FIGS. 15A and 15B are schematic diagrams of a protrusion portion 11 according to the present example embodiment. In the present example embodiment, the protrusion portion 11 has a tapered shape as illustrated in FIG. 15A. Hereinafter, components and configurations that are similar to the above first example embodiment will be given the same reference numerals as above and description thereof will be omitted.

In the present disclosure, as illustrated in FIG. 15A, a protrusion portion can have a tapered shape. If a fiber 200 is caught on the protrusion portion 11, a stress is concentrated in a root of the protrusion portion 11. Accordingly, a width of the root is made thicker than a width of a tip portion to disperse the stress to prevent damage to the protrusion portion 11. Herein, the width of the tip portion in the case where the tip portion has a curvature is a value of twice the curvature radius of the tip portion.

On the other hand, if a distance between protrusion portions 11 is reduced to make a protrusion thicker, discharged droplets may be split in a discharge direction and in a vertical direction. Particularly, if a thickness of the tip portion of the protrusion portion 11 is greater than a minimum protrusion distance d, a shape of the discharge port 10 becomes similar to two semicircles. Hence, the split occurs more easily.

As illustrated in FIG. 15A, if the protrusion portion is formed in a tapered shape, a mechanical strength can be obtained with a thicker root, and an effect of preventing droplets from splitting can be obtained by using a thinner tip portion. A protrusion may have a curvature in the tip portion. In such a case, a protrusion distance d can be desirably greater than a curvature radius of the tip portion to prevent the droplet splitting. In the present example embodiment, as an example, the protrusion portion 11 has a tip portion having a width D1 of 2 μm and a root having a width D2 of 4 μm. Further, a minimum protrusion distance d is 3 μm, the tip portion 15 has a curvature radius of 2 μm, and a root 16 has a curvature radius of 3 μm.

Moreover, an outer edge shape of the discharge port 10 can be any of circle, oval, and rectangle.

A fifth example embodiment is hereinafter described. FIGS. 16A through 16I and 17A through 17E are schematic diagrams illustrating a portion for measuring a size φ of a fiber 200, a discharge port 10, and a fiber 200 according to the present example embodiment. In the present example embodiment, as illustrated in FIGS. 16A through 16I and 17A through 17E, the fiber 200 having a non-circular cross-section is used as a head cleaning member. Hereinafter, components and configurations that are similar to the above first example embodiment will be given the same reference numerals as above and description thereof will be omitted.

Figure 16A:
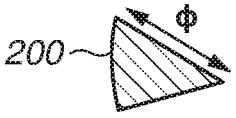
FIG. 16A is a diagram of a measurement portion for a size φ of a fiber having a non-circular cross-section.
Figure 16B:
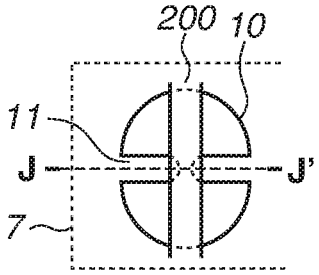
FIG. 16B is a top view of a discharge port and a fiber according to a fifth example embodiment
Figure 16D:
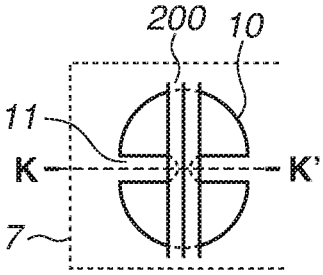
FIG. 16D is a top view of a discharge port and a fiber according to the fifth example embodiment
Figure 16C:
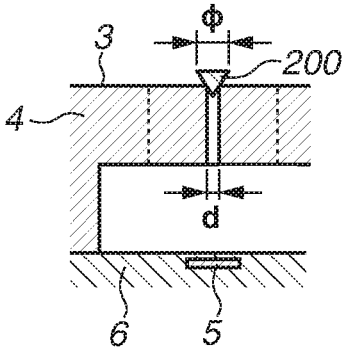
FIG. 16C is a sectional view along the line J-J' of FIG. 16B.
Figure 16E:
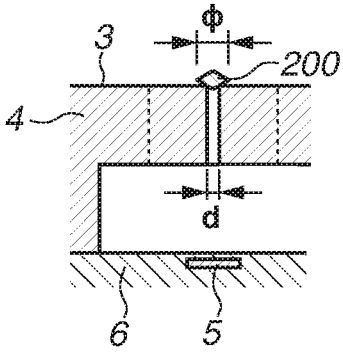
FIG. 16E is a sectional view along the line K-K' of FIG. 16D.
Figure 16F:
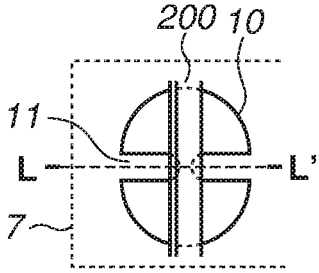
FIG. 16F is a top view of a discharge port and a fiber according to the fifth example embodiment.
Figure 16H:
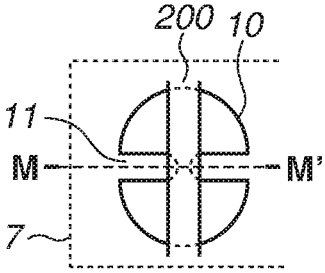
FIG. 16H is a top view of a discharge port and a fiber according to the fifth example embodiment.
Figure 16G:
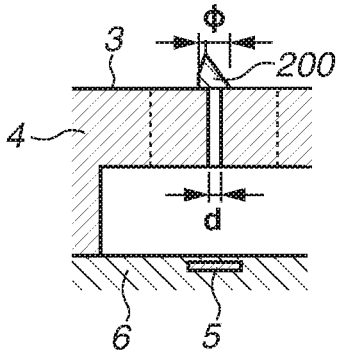
FIG. 16G is a sectional view along the line L-L' of FIG. 16F.
Figure 16I:
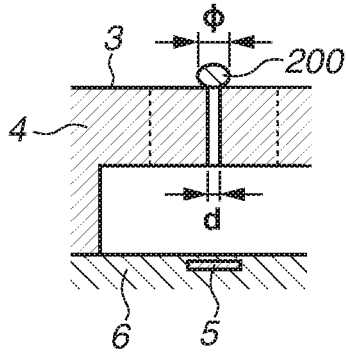
FIG. 16I is a sectional view along the line M-M' of FIG. 16H.

FIG. 16A is a diagram illustrating the portion for measuring a size φ of a fiber 20 having a non-circular cross-section. As illustrated in FIG. 16A, a maximum length of a straight line of a fiber in a vertical cross-section is set to a size φ of a fiber 200. That is, if the fiber 200 has an oval cross-section, the major axis is the size φ. If the fiber 200 has a rectangular cross-section, a length of a diagonal line is the size φ. FIGS. 16B through 16I are diagrams illustrating a relation between a discharge port 10 and a fiber 200 when a discharge port surface 3 is cleaned using the fiber 200 having a length as illustrated in FIG. 16A as the size p. FIG. 16B is a top view of the discharge port 10 and a fiber 200 having a triangular cross-section, and FIG. 16C is a sectional view along the line J-J' of FIG. 16B. FIG. 16D is a top view of the discharge port 10 and a fiber 200 having a rectangular cross-section, and FIG. 16E is a sectional view along the line K-K' of FIG. 16D. FIG. 16F is a top view of the discharge port 10 and a fiber 200 having a sectorial cross-section, and FIG. 16G is a sectional view along the line L-L' of FIG. 16F. FIG. 16H is a top view of the discharge port 10 and a fiber 200 having an oval cross-section, and FIG. 16I is a sectional view along the line M-M' of FIG. 16H.

A cross-section of the fiber 200 has an edge portion, so that adherents on a discharge port surface can be scraped by the fiber edge portion. Hence, the discharge port surface 3 is cleaned with efficiency. Also in this case where the fiber 200 has such a non-circular cross-section, the size φ of the fiber 200 can be set greater than a distance between protrusion portions 11, so that an entry of the fiber 200 into the inside of the discharge port can be prevented, and the protrusion portion 11 can be prevented from being damaged.

Figure 17A:
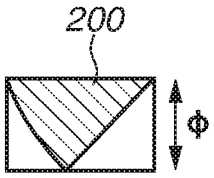
FIG. 17A is a diagram of a measurement portion for a size φ of fiber having a non-circular cross-section.

FIG. 17A is a diagram illustrating a portion for measuring a size φ of a fiber 200 having a non-circular cross-section.

Figure 17B:
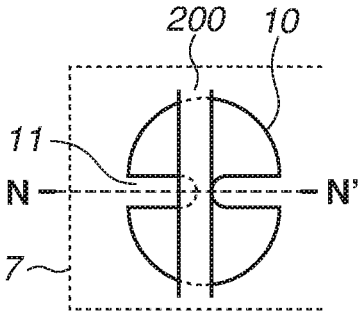
FIG. 17B is a top view of a discharge port and a fiber according to the fifth example embodiment.
Figure 17D:
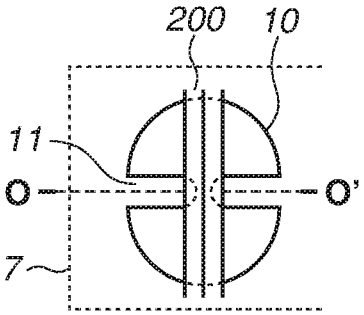
FIG. 17D is a top view of a discharge port and a fiber according to the fifth example embodiment.
Figure 17C:
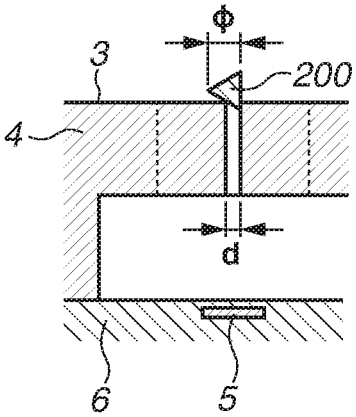
FIG. 17C is a sectional view along the line N-N' of FIG. 17B.
Figure 17E:
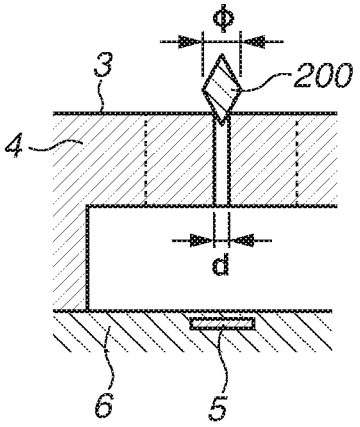
FIG. 17E is a sectional view along the line O-O' of FIG. 17D.

As illustrated in FIG. 17A, a minimum length of a narrow side of a rectangle among rectangles which include a vertical cross-section of a fiber is set to a size of the fiber 200. FIG. 17B through 17E are diagrams illustrating a relation between a discharge port 10 and a fiber 200 when a discharge port surface 3 is cleaned using the fiber 200 having a length as illustrated in FIG. 17A as a size φ. FIG. 17B is a top view of the discharge port 10 and a fiber 200 having a triangular cross-section, and FIG. 17C is a sectional view along the line N-N' of FIG. 17B. FIG. 17D is a top view of the discharge port 10 and a fiber 200 having a rectangular cross-section, and FIG. 17E is a sectional view along the line O-O' of FIG. 17D.

Arrangement of a size φ of the fiber 200 as illustrated in FIG. 17A can prevent an entry of the fiber 200 into the inside of the discharge port even if the fiber 200 contacts the head cleaning member 100 at various angles. Therefore, an effect of preventing the discharge port 10 from being damaged can be obtained.

The present disclosure is not limited to a case where a fiber has a polygonal, sectorial, or oval cross-section. Fibers can have various cross-sections.

A sixth example embodiment is hereinafter described. FIGS. 18A through 18F are schematic diagrams of a discharge port 10 including a protrusion portion 11 including a recessed portion. In the present example embodiment, as illustrated in FIGS. 18A through 18F, the protrusion portion 11 includes a recessed portion. Hereinafter, components and configurations that are similar to the above first example embodiment will be given the same reference numerals as above and description thereof will be omitted.

Figure 18A:
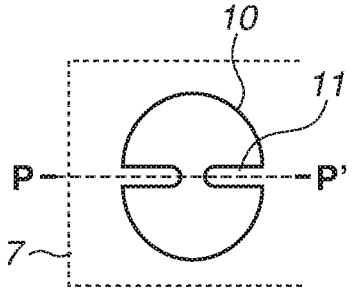
FIG. 18A is a top view of a discharge port and a fiber according to a sixth example embodiment.
Figure 18C:
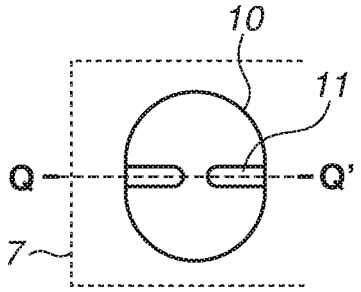
FIG. 18C is a top view of a discharge port and a fiber according to the sixth example embodiment.
Figure 18B:
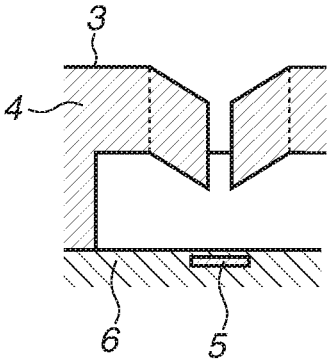
FIG. 18B is a sectional view along the line P-P' of FIG. 18A.
Figure 18D:
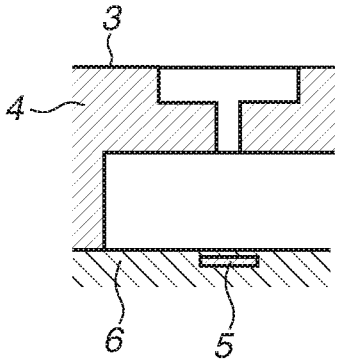
FIG. 18D is a sectional view along the line Q-Q' of FIG. 18C.
Figure 18E:
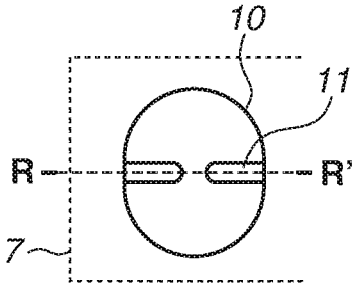
FIG. 18E is a top view of a discharge port and a fiber according to the sixth example embodiment.
Figure 18F:
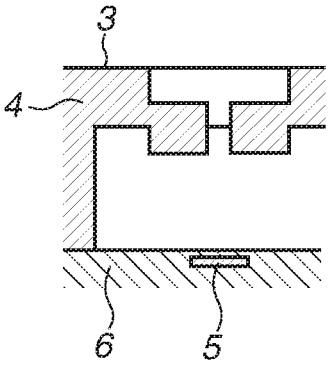
FIG. 18F is a sectional view along the line R-R' of FIG. 18E.

A top view of FIG. 18A and a sectional view of FIG. 18B illustrate a discharge port 10 including a protrusion portion 11 with a tip portion that sinks toward a heat resistance element 5. A top view of FIG. 18C and a sectional view of FIG. 18D illustrate a discharge port 10 including a protrusion portion 11 in which a surface thereof on the discharge port surface side has a dent shape. A top view of FIG. 18E and a sectional view of FIG. 18F illustrate a discharge port 10 including a protrusion portion 11 in which both surfaces thereof on the discharge port surface 3 side and the heat resistance element 5 side have dent shapes.

With such shapes, a certain distance can be provided between the discharge port surface 3 and a protrusion inter-protrusion area. Hence, the fiber 200 can be prevented from entering a discharge port inner side, and an effect of preventing damage to the protrusion portion 11 can be further enhanced.

A shape of the discharge port 10 is not limited to that described in the present example embodiment. The discharge port 10 can have a bowl-shaped recessed portion, and a protrusion portion can be arranged on the bottom of the recessed portion.

Each of the example embodiments of the present disclosure has been described. However, the present disclosure is not limited to a configuration of each of the example embodiments. The present disclosure can be appropriately applied to a combination of the example embodiments.

According to the present disclosure, in a liquid discharge apparatus, even if a cleaning method using fibers is used to clean a discharge port surface including a discharge port having a protrusion portion, the protrusion portion can be prevented from being damaged.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2018-012546, filed Jan. 29, 2018, which is hereby incorporated by reference herein in its entirety.

What is claimed is:

1. A liquid discharge apparatus comprising:

a liquid discharge head including a discharge port configured to discharge liquid and a discharge port surface provided with the discharge port; and a head cleaning member including a contact portion that contacts the discharge port surface, and configured to cause the contact portion to contact the discharge port surface and to move relative to the discharge port surface in order to clean adherents attached to the discharge port surface, wherein the discharge port includes a plurality of protrusion portions extending toward a discharge port inner side, wherein the contact portion includes a fiber, and wherein the fiber in the contact portion includes a portion having a size greater than a minimum protrusion distance among protrusion distances between the protrusion portions.

2. The liquid discharge apparatus according to claim 1, wherein an average size of each fiber per unit length in the contact portion is greater than the minimum protrusion distance among the protrusion distances.

3. The liquid discharge apparatus according to claim 1, wherein a 90% or more part of the fiber in the contact portion has a size greater than the minimum protrusion distance among the protrusion distances.

4. The liquid discharge apparatus according to claim 1, wherein the protrusion portions are two protrusion portions that are opposite to each other.

5. The liquid discharge apparatus according to claim 1, wherein a size of the fiber in the contact portion is a maximum length of a straight line in vertical cross-section of the fiber in the contact portion.

6. The liquid discharge apparatus according to claim 1, wherein a size of the fiber in the contact portion is that of a narrow side of a rectangle which has a minimum narrow side, from among rectangles which can include a vertical cross-section shape of the fiber in the contact portion.

7. The liquid discharge apparatus according to claim 1, wherein the minimum protrusion distance among the protrusion distances is greater than a width of a tip portion of the protrusion portion.

8. The liquid discharge apparatus according to claim 1, wherein the minimum protrusion distance among the protrusion distances is greater than a curvature radius of a tip portion of the protrusion portion.

9. The liquid discharge apparatus according to claim 1, wherein a width of a root of the protrusion portion is greater than a width of a tip portion of the protrusion portion.

10. The liquid discharge apparatus according to claim 1, wherein an angle between a direction of the relative movement and a direction in which the protrusion portion extends is 45 degrees or less.

11. The liquid discharge apparatus according to claim 1, wherein the liquid is ink.

12. The liquid discharge apparatus according to claim 11, wherein the ink has a solid content between 5 weight % and 30 weight %.

13. A cleaning method using a head cleaning member including a contact portion that contacts a discharge port surface of a liquid discharge head including a discharge port configured to discharge liquid and the discharge port surface with the discharge port, the cleaning method comprising:

causing the contact portion to contact the discharge port surface and to move relative to the discharge port surface to clean adherents attached to the discharge port surface, wherein the discharge port includes a plurality of protrusion portions extending toward a discharge port inner side, wherein the contact portion includes a fiber, and wherein the fiber in the contact portion includes a portion having a size greater than a minimum distance among protrusion distances between the protrusion portions.

14. The cleaning method according to claim 13, wherein an average value of size of each of the fibers per unit length in the contact portion is greater than the minimum protrusion distance among the protrusion distances.

15. The cleaning method according to claim 13, wherein a 90% or more part of the fiber in the contact portion has a size greater than the minimum protrusion distance among the protrusion distances.

16. The cleaning method according to claim 13, wherein the protrusion portions are two portions that are opposite to each other.

17. The cleaning method according to claim 13, wherein a size of the fiber in the contact portion is a maximum length of a straight line in vertical cross-section of the fiber in the contact portion.

18. The cleaning method according to claim 13, wherein a size of the fiber in the contact portion is that of a narrow side of a rectangle which has a minimum narrow side, from among rectangles which can include a vertical cross-section shape of the fiber in the contact portion.

19. The cleaning method according to claim 13, wherein the minimum protrusion distance among the protrusion distances is greater than a width of a tip portion of the protrusion portion.

20. The cleaning method according to claim 13, wherein the minimum protrusion distance among the protrusion distances is greater than a curvature radius of a tip portion of the protrusion portion.

21. The cleaning method according to claim 13, wherein a width of a root of the protrusion portion is greater than a width of a tip portion of the protrusion portion.

22. The cleaning method according to claim 13, wherein an angle between a direction of the relative movement and a direction in which the protrusion portion extends is 45 degrees or less.

23. The cleaning method according to claim 13, wherein the liquid is ink.

24. The cleaning method according to claim 23, wherein the ink has a solid content between 5 weight % and 30 weight %.

* * * * *